US006620064B2

(12) United States Patent
Nickerson

(10) Patent No.: US 6,620,064 B2
(45) Date of Patent: Sep. 16, 2003

(54) RETURN NET DEVICE

(75) Inventor: Andrew S. Nickerson, Yarmouth (CA)

(73) Assignee: Batterup Sports Tech Ltd., Yarmouth (CA)

( * ) Notice: Subject to any disclaimer, the term of this patent is extended or adjusted under 35 U.S.C. 154(b) by 0 days.

(21) Appl. No.: 09/752,696

(22) Filed: Jan. 3, 2001

(65) Prior Publication Data

US 2003/0087712 A1 May 8, 2003

(51) Int. Cl.[7] ..... A63B 69/00; A63B 67/00

(52) U.S. Cl. ..... 473/431; 473/421; 473/422; 473/432

(58) Field of Search ..... 273/348, 400, 273/402, 407, 410, 394–397; 473/173, 197, 131–133, 416, 417, 421, 422, 431, 432, 436, 451, 454, 456, 135–137, FOR 103, FOR 104; 124/7, 53.5, 73, 79

(56) References Cited

U.S. PATENT DOCUMENTS

| | | | | | |
|---|---|---|---|---|---|
| 1,043,308 | A | * | 11/1912 | Everson | 473/432 |
| 2,082,818 | A | * | 6/1937 | Atwell | 473/436 |
| 2,089,526 | A | | 8/1937 | Andreas | |
| 3,001,795 | A | * | 9/1961 | Johnson, Jr. | 473/421 |
| 4,275,883 | A | * | 6/1981 | Grimaldi et al. | 473/432 |
| 4,575,081 | A | | 3/1986 | Cavanagh | |
| 4,974,843 | A | * | 12/1990 | Henningsson | 473/431 |
| 5,133,548 | A | * | 7/1992 | Bedord et al. | 473/436 |
| 5,141,226 | A | | 8/1992 | Cavanagh | |
| 5,205,564 | A | | 4/1993 | Lamberti et al. | |
| 5,271,616 | A | * | 12/1993 | Grimaldi | 473/432 |
| 5,485,994 | A | * | 1/1996 | Underwood et al. | 473/451 |
| 5,588,645 | A | | 12/1996 | Schwan et al. | |
| 5,730,442 | A | * | 3/1998 | Anderson | 473/421 |
| 5,730,666 | A | * | 3/1998 | Hudson | 473/421 |
| 5,733,209 | A | | 3/1998 | McIntyre, IV | |
| 5,746,670 | A | | 5/1998 | Brady | |
| 6,155,936 | A | * | 12/2000 | Dorr | 473/436 |
| 6,167,878 | B1 | | 1/2001 | Nickerson et al. | |

FOREIGN PATENT DOCUMENTS

| | | |
|---|---|---|
| CA | 2250647 | 4/2000 |
| CA | 2329919 | 7/2002 |

* cited by examiner

*Primary Examiner*—Paul T. Sewell
*Assistant Examiner*—Mitra Aryanpour
(74) *Attorney, Agent, or Firm*—Nixon & Vanderhye P.C.

(57) ABSTRACT

A portable return net device for receiving, arresting and returning a ball to a central collection point for pitched, thrown or batted balls in a ball practice system. The return net apparatus comprises; a net supporting frame, a net for receiving a projected ball, an inclined collection tray operatively associated with the net, and an exit chute, wherein the net is hung untensioned on the supporting frame, on the diagonal, and wherein flaps extending transversely across the base of the hanging net are pivotally connected thereto. The net absorbs the impact of a ball in conjunction with the flaps which trap a ball impacting a tensile zone of the net. The tensile zone comprises that portion of the hanging net below which there is insufficient net weight to arrest a ball in a triangular portion of the net below the point of impact. The arrested ball is conveyed by the collection tray to the exit chute for reuse.

19 Claims, 3 Drawing Sheets

RETURN NET DEVICE

FIELD OF THE INVENTION

This invention relates to a return net device for receiving, arresting and returning a ball to a central collection point. Although the system is intended primarily for use in conjunction with a baseball tossing device as a baseball batting practice system, it is also equally usable for receiving pitched or thrown balls in a pitching or throwing practice system. The structure and principles of the present system may also be used for practice with other ball games such as golf and soccer.

BACKGROUND OF THE INVENTION

Net systems for receiving pitched, thrown or batted balls are known. Typically, a pitched or batted ball is directed toward a net suspended on a frame. The ball is either stopped or redirected by the net (such that the ball falls to the ground for subsequent collection), or it may have a resilience which causes the ball to rebound towards the batter or pitcher. Examples of such net systems are disclosed in U.S. Pat. Nos. 5,205,564 and 5,588,645 and Canadian patent 2,089,526.

The disadvantage of these systems is apparent. Either the pitcher or an assistant must collect the ball from the net and return it to the batting or pitching position, or the ball may rebound erratically generally towards the batter or pitcher, which still requires collection before use.

It has been recognised that a system which both stops and collects the balls for return to the batter or pitcher would be advantageous. Mechanical systems to move the collected balls are disclosed in U.S. Pat. Nos. 4,575,081 and 5,141,226. A gravity return device is disclosed in U.S. Pat. No. 5,746,670 which has a return net and a collection system for operation in association with a ball pitching device. The system, however, relies solely on the net to stop a ball and consequently a pitched ball may rebound from the net, jumping over the tray and still require collection. Clearly a system that fully arrests the ball on impact is desirable.

SUMMARY OF THE INVENTION

The present invention is a training device for batting or pitching practice. In a game, such as baseball or variations thereof, a ball may be batted or pitched. In training practice, where repetitive pitching or batting is required, a net may be used to aid in stopping of projected balls, thereby saving extensive effort to retrieve distant balls. Further, a system which will not only stop the balls, but collect them is of greater advantage. Finally, a system which will not only stop and collect the balls but also return them to a point of use will be of even greater advantage.

The present invention comprises a ball catching and return net suspended loosely from a frame, and includes an inclined collection tray portion mounted on the frame so as to receive balls which have been stopped by the net, and funnel them to a collection point adjacent the batter or pitcher utilizing the system. In the case of batting practice, the return net device can be associated with a ball tossing device such that the ball is tossed consistently for the batter, and the batter then bats the ball into the net where it is arrested, drops to the collection tray, and rolls down the collection tray to a collection point and into a chute which returns the ball to the ball tossing machine for reuse. In the event of pitching practice, the ball would be pitched into the net, arrested, drop to the tray and roll to a collection point for reuse by the pitcher.

In such a return net, the user is situated relatively close to the net. Normally the distance is not much more than the radius of a swung bat, and often will constitute no more than six feet between a batter and the net. Consequently, it is necessary that the net system not be so resilient as to cause or allow projected balls to rebound towards the pitcher or batter, or even to rebound out of a collection tray.

In accordance with one embodiment of the invention, a net comprising a rectangular or diamond pattern is hung on the diagonal such that the weight of the triangular portion of the net below the point of contact with the ball is sufficient to resist the momentum of the ball and bring it to a complete stop, permitting the ball to drop to the inclined collection tray below. In a further embodiment of the invention, the net includes a series of rectangular flaps attached to the net where the hanging net contacts the collection tray. In the event a ball is pitched or batted into the lower portion of the net, i.e. the tensile zone, where the weight of the net in the triangle below the point of ball contact with the net is insufficient to totally arrest the ball, one or more flaps can rotate upwardly to trap the ball against the net, thereby preventing rebound of the ball. The flaps then drop back onto the tray and allow the ball to roll to the collection point.

The present invention overcomes the problems inherent with existing ball receiving nets. In particular, the present system arrests a ball on impact, and substantially prevents any rebound of the ball. Furthermore, the present system funnels the ball, on a gravity feed, to a collection point where it may be used immediately by a pitcher or fed into a ball tossing machine, such as disclosed in our allowed U.S. patent application Ser. No. 09/232,228 filed Jan. 19, 1999 for a Pneumatic Ball Tossing Device. These and other advantages of the present system are disclosed hereafter in conjunction with the description of various embodiments of the invention and the associated drawings.

DETAILED DESCRIPTION OF THE ILLUSTRATED EMBODIMENTS

Figure 1:
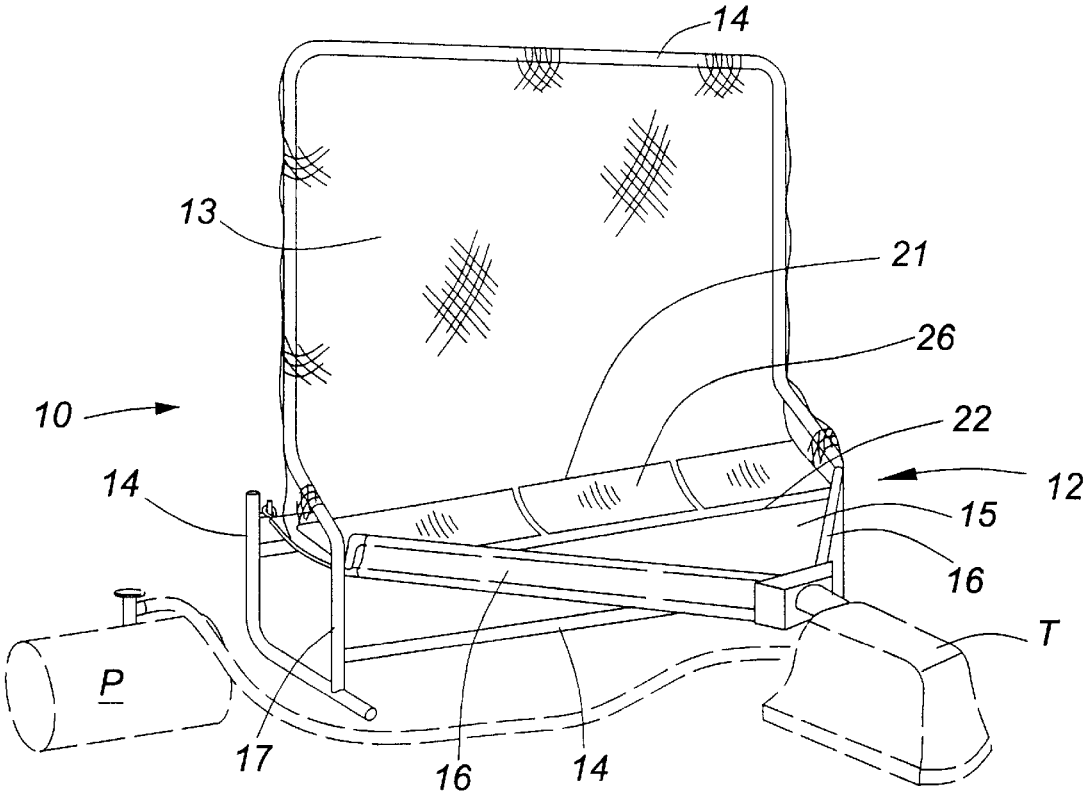
FIG. 1 is a perspective view illustrating the return net device, with an optional ball tossing device shown in phantom.
Figure 2:
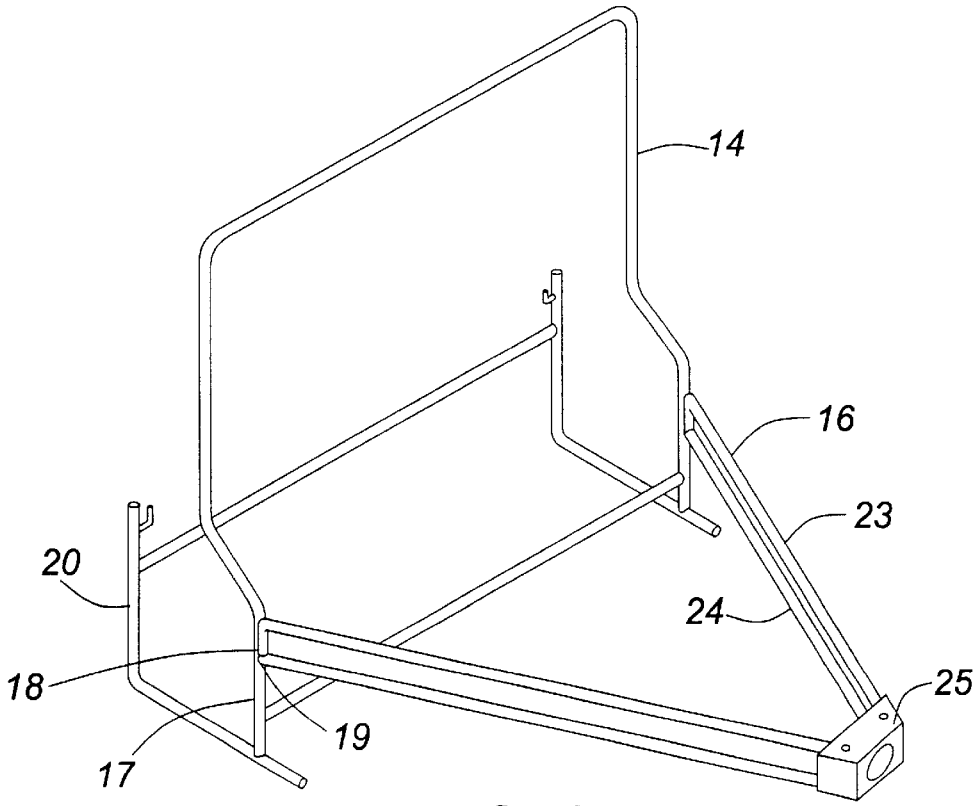
FIG. 2 is a perspective view of the frame of the device.

Referring now to the embodiment illustrated in FIG. 1, a return net device 10 comprises a net portion 11 and a collection tray portion 12. The net portion 11, has a net 13 suspended from a frame 14. The frame, which may comprise a plurality of interconnected tubular members, is arranged to be self-standing, and to accept for attachment the collection tray portion 12. A typical frame is approximately six feet square and the tray extends approximately four feet forwardly thereof The net 13 is attached to the frame 14 such that the vertical portion is freely hanging, and the base portion lies on a collection tray 15. In a preferred embodiment, the net 13 is formed with an appropriate perimeter sleeve into which the frame members 14 may be socketed during assembly. The frame itself comprises interconnecting rod members which may be socketted together and which may be disassembled for ease of transport or storage. The net 13 is preferably a woven mesh or netting of synthetic material such as nylon. One product which has been successfully used by the applicant is a woven nylon mesh of one eighth inch spacing, having a weight of approximately one oz. per square foot. A larger mesh size would require a heavier mesh to retain the same weight distribution. In general, the mesh may have a weight in the range of 0.5 to 4 oz. per square foot.

The collection tray portion 12 comprises the tray 15 which is connected to a tray frame 16. The key frame 16 is in turn connected to the front legs 17 of net frame 14, by means of pintal 18 on each leg and a cooperating gudgeon 19 on the tray frame 16. The back end of the tray 15 is connected to the back legs 20 of the net frame 14 by means of adjustable straps or equivalent adjustable connectors. When the device is assembled, the net 13 hangs vertically until it contacts the surface of the collection tray 15 at a contact line 21 extending generally horizontally from side to side of the tray. Below that contact line 21, the net overlies the surface of the tray 15, terminating at a front edge 22 extending transversely across the tray adjacent the front edge of the net frame 14, where it is attached, such as by sewing, to the tray 15.

The collection tray 15 is made preferably of a non-resilient fabric which may be of the type utilized for trampoline surfaces. One such fabric, HERCULITE, is a woven nylon fabric coated with a nylon facing, manufactured by Inland Plastics, model number IP-1850. The fabric has a weight of approximately 2½ oz. per square foot, although weight of up to 5 oz. may be effective in larger trays. For other trays, however, fabrics as light as one oz. per square foot may suffice. The tray 15 has a forward triangular portion which is attached to the tray frame 16 and a rearward rectangular portion which extends within the net frame 14 to the back legs 20 of the net frame. The collection tray frame 16 is generally V-shaped, which each arm thereof comprising an upper member 23 and a lower member 24 connected at the apex by an apertured bracket plate 25. One or both of the arms may be pivotally connected to the apex plate 25, such as by bolts to permit the arms to be folded into a parallel position during transportation or storage of the device.

In a preferred embodiment of the device, the upper and lower members 23 and 24 of the collector arms 16 are not positioned vertically above one another, but the upper member 23 is inclined inwardly approximately twelve degrees from the lower member 24 to assist in retention of a returning ball within the tray 15.

The triangular front portion of the collection tray 15 is attached to the collection tray frame 16 such that outer fabric edges pass beneath the lower members 24 and are connected to the upper members 23 such as by a sleeve or socket in the fabric edge. In a preferred aspect of the device, at least one fabric edge is connected to the upper arm by an adjustable attachment such as velcro or adjustable straps, assisting in maintaining the tray in appropriate tension.

When the tray is installed for operation, it is inclined downwardly towards the apertured apex plate 25 at approximately an eight degree slope. It has been found that adequate tension in the tray is such that the fabric tray 15 does not sag sufficiently to prevent a ball from rolling on the eight degree slope to the aperture apex plate 25, while being loose enough to prevent a ball from rebounding when impacting the tray 15. The back rectangular portion of the tray 15 extends the eight degree slope through the net frame 14 to the point of attachment to the back legs 20 of the net frame 14.

Figure 3:
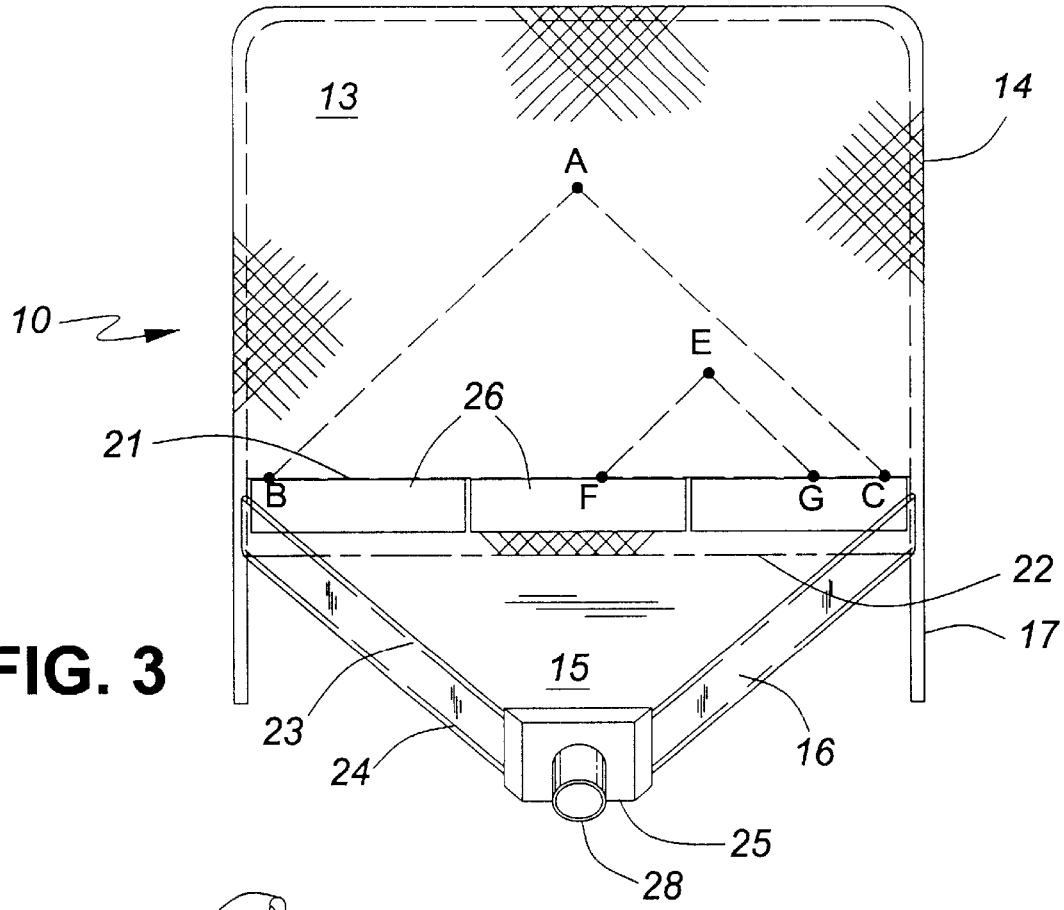
FIG. 3 is a frontal view of the return net device of the invention.
Figure 4:
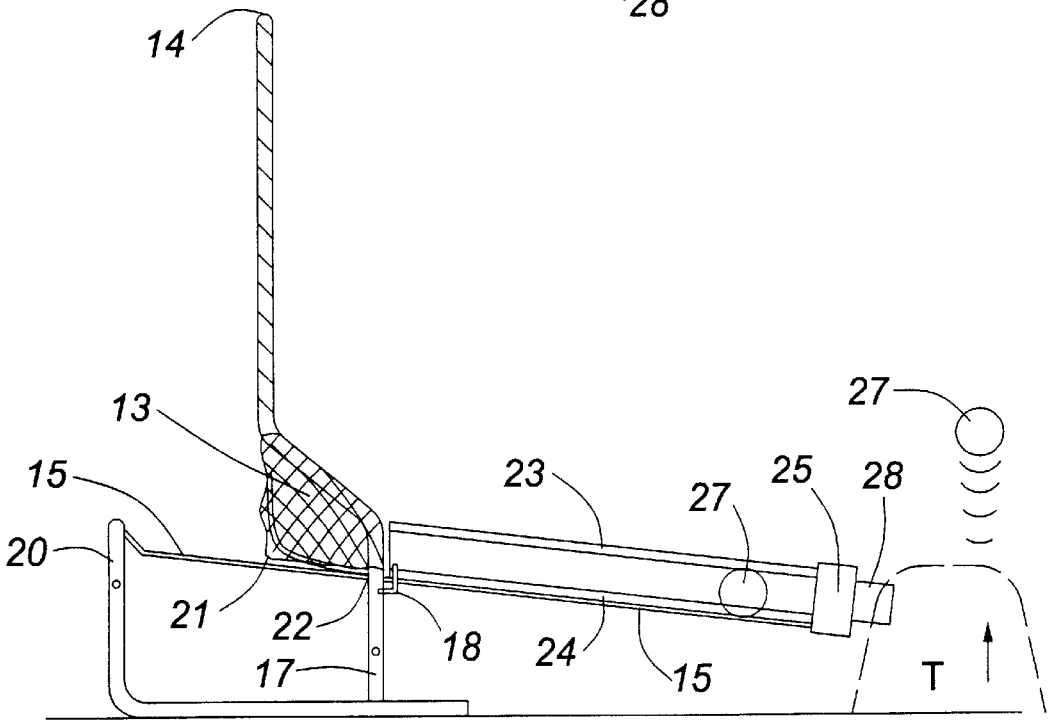
FIG. 4 is a side view of the return net device of the invention.

As previously mentioned, and as may be seen in FIGS. 1 and 3, the net 13 is hung, preferably on the diagonal, such that the upper part of the net 13 hangs vertically from the frame 14 to a line of contact 21 against the inclined collection tray 15, which defines the base of the hanging portion. The net then inclines downwardly, overlying the surface of the tray 15 to the lower or termination edge 22 adjacent the front edge of the net frame 16. One or more rectangular flaps 26 are pivotally attached to the netting along the line of contact 21. These flaps may have a weight in the range of 1 to 10 oz. per square foot, and may also be made from doubled layers of the HERCULITE material. The total length of the flaps should extend longitudinally across the net, and each flap should have a width (vertical dimension) sufficient that when flipped vertically, it will trap a ball struck or thrown into the tensile zone as defined hereafter.

The ball return net device of the present invention may be used to receive pitched or thrown balls, or to receive balls batted into the net from a ball tossing apparatus for batting training, such as illustrated as T in FIG. 1. The tossing apparatus may be powered by an air tank or pig P for portability of the training apparatus.

Operation of the Net

Prior art return nets have traditionally been installed with at least a minor degree of tension between their frame members. This tension creates a resistence in the net structure, causing a ball or other projectile to rebound from the net, or apparently to be thrown back towards the user. In contrast, the net of the present invention endeavours to eliminate rebound in the net structure. It is intended that the present net 13 of the device absorb the full kinetic energy of a propelled ball 27, causing the ball to stop and drop to the collection tray 15 below for return to a collection chute 28 at the apex plate 25. It is considered that the present net 13, hanging loosely (i.e. without tension) within its frame 14 allow the net material to move under the impact of a ball. It is further believed that, in the preferred operation of the net, a propelled ball is arrested by the weight of the net below the point of impact. In principal, a propelled ball forces the netting below the point of impact to move upwardly and rearwardly, thereby lifting a portion of the net below the ball. More importantly, in the present invention, the mesh of the net is strung on the diagonal. Consequently, it is believed that a propelled ball is arrested by the weight of an area of the net comprising a triangle with its apex at the point of impact. With the diagonal orientation of the mesh of the net 13, the weight in the triangular portion of the net below the point of impact is available to be lifted and to resist and overcome the kinetic energy of the ball. This is a substantially greater area and weight than if the net was strung orthogonally, and tension was therefore placed only in the generally narrow rectangular net portion immediately below the point of impact.

From the foregoing and as may be seen in FIG. 3, it would appear that a ball impacting in the upper portion of the net 13 such as at point A clearly has a large triangular area (ABC) below the point of impact, with sufficient net weight to arrest the ball before the net can extend into tension against its lower attachment edge 22. However, in the event that a ball is propelled into the lower or "tensile" portion of the net such as at point E, the triangular area (EFG) below the point of impact E is smaller, providing less net weight to arrest the ball, and consequently the risk of the net being taken into tension before the ball is fully stopped is greater. It will be appreciated that if the net goes into tension, the taught net will tend to cause the ball to rebound towards the batter or thrower. Tension, and consequent rebound, as may be expected, could cause the ball to be projected beyond the limits of the collection tray preventing the return of the ball to the collection chute 28. The present invention recognizes and addresses this problem by providing a plurality of flaps 26 at contact line 21 adjacent the bottom of the hanging portion of the net. These flaps 26, generally rectangular, with a long axis extending transversely across the net, are flexibly or pivotally attached to the net along their upper longitudinal edge at contact line 21.

Figure 5A:
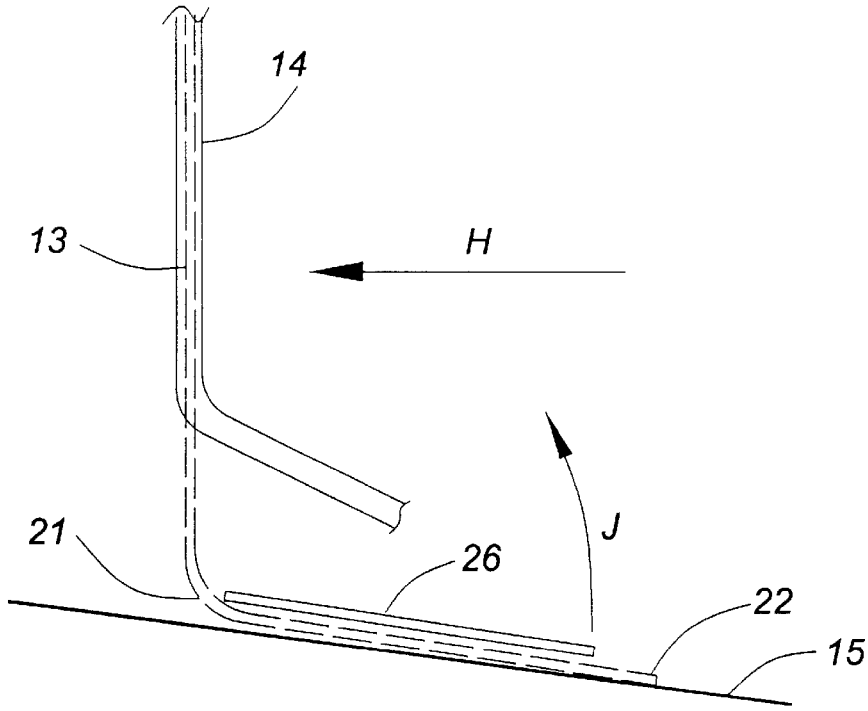
FIG. 5A is a detail of the net and flaps of FIG. 4 prior to impact of a ball.
Figure 5B:
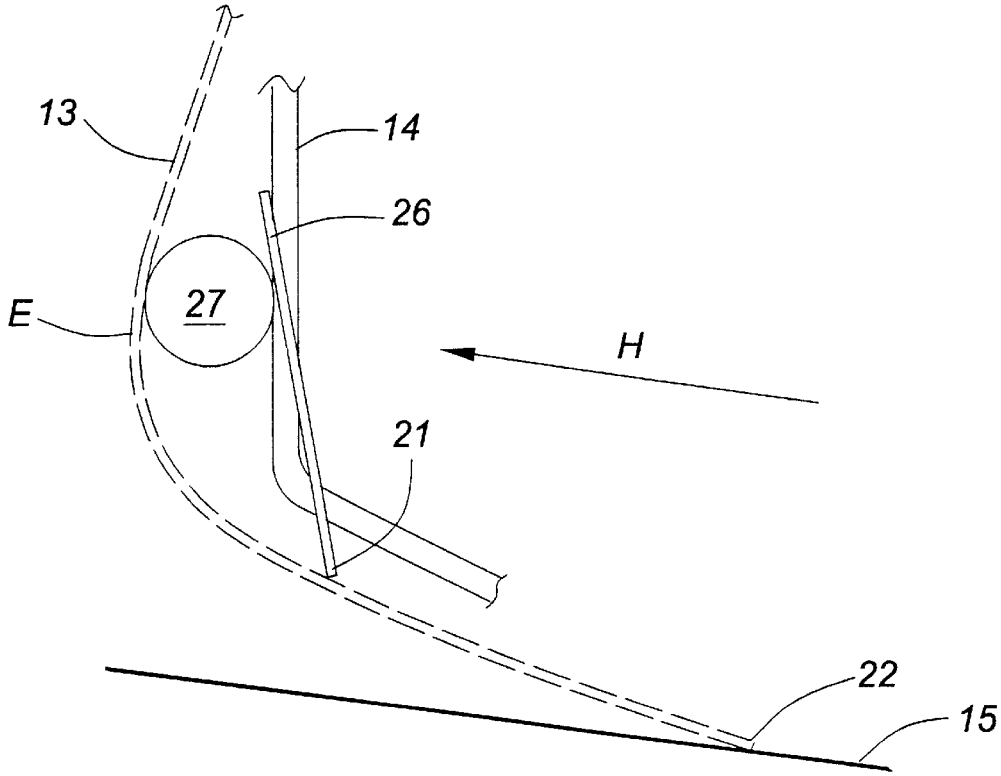
FIG. 5B is a further detail of the net and flap of FIG. 4 after impact of the ball.

Referring to FIGS. 5A and 5B, it may be seen that, prior to impact of a ball, the net is loosely suspended from the upper frame member, and extends downwardly to overlie a portion of the collection tray 16 a distance from the contact line 21. The flaps 26 are attached to the net such that the flaps also lie flat against the net portion supported by the collection tray. When a ball 27, travelling in the direction of arrow H, impacts the lower or tensile portion of the net, the ball is resisted not only by the weight of the triangular area of the net below the point of impact (i.e. EFG), but is also resisted by the weight of the flaps. More importantly, however, under the influence of the impact of a ball on the net, the net is stressed, or tensioned, and drawn upwardly and rearwardly. This capability for upward movement is permitted by the novel length of netting between contact line 21 and the termination 22 whereby the net is not constrained at contact line 21. Applicant has observed that this upward and rearward motion of the net causes the flaps 26 to pivot upwardly about their rearward point of attachment at 21, (i.e., to flip upwardly in the direction of arrow J) whereby the flaps operate to trap the ball between the net surface and the upwardly flipped flap member, thereby preventing any rebound. Once the ball 27 is stopped by a combination of net weight, and trapping by the flaps, the net relaxes, the flaps drop down generally into their initial position on the tray 15, and the ball rolls loose over the net and flaps on to the collection tray and to the apex plate and chute 28. The flaps 26 are generally stiff, and may be made of the same material as the collection tray surface.

Applicant has found that the net preferably may be positioned approximately four feet from the batter or pitcher's position, although much greater distances are possible in a throwing practice workout. In a device made by the inventor, the frame and net has a six foot width, with the net having a 60 inch vertical hanging portion and a 12 inch inclined portion resting against the surface of the collection tray 15. The net is formed of a diagonally strung mesh of approximately ⅛ inch mesh opening. The weight of the mesh is important. If the mesh is too light, there may be insufficient weight to resist the momentum of a ball, or larger flaps may be required to provide that additional weight. Although an eighth inch nylon mesh weighing one oz. per square foot has been found to be sufficient, a quarter inch mesh may be adequate if made of heavier strand. In a preferred embodiment of the invention, the inventor has utilized three flaps, each about 24 inches long and 12 inches wide. With this particular embodiment, a ball pitched more than 12 inches above the collection tray will be arrested by the weight of the net before the net is subjected to any significant tension. On the other hand, a ball impacting the net at less than 12 inches from the tray (i.e. in the tensile zone) will generally be too low for there to be sufficient net weight to absorb the momentum of the ball. Consequently, the impact of such a ball causes the net to be pushed back, upwardly, and into tension, whereby the flaps are flipped upwardly into a vertical orientation, thereby trapping the ball between the net and the flipped flap.

As previously noted, when the ball has been fully arrested, the net sags back to its initial position, the flaps drop and the ball is free to roll over the flap and collection tray to the collection point.

This invention has been described in terms of preferred embodiments, embracing certain sizes and materials for its component members. It is clear that variations in these described embodiments may be made by persons skilled in the art without departing from the inventive concept. It is intended that these variations be included within the scope of the appended claims.

What is claimed is:

1. A ball return net apparatus, adapted to be selectively operated in conjunction with a ball tossing system, the apparatus comprising:

a net supporting frame;

a net on the frame to receive and arrest a projected ball;

a forwardly inclined collection tray operatively associated with the net; and an exit chute arranged such that the tray funnels the ball to the exit chute;

wherein the net is hung untensioned on the supporting frame, on the diagonal, and wherein the net includes an inclined extension overlying and attached on a forward portion of the collection tray, and further wherein one or more flaps extend transversely across the base of the hanging net and are pivotally connected thereto.

2. The apparatus of claim 1 wherein the flaps are pivotally connected adjacent the base of the net for pivotal motion between a first position supported parallel to the tray surface, and a second generally vertical position extending upwardly from the tray, generally parallel to the hanging net surface.

3. The apparatus of claim 2 wherein a ball impacting on the net in a tensile zone adjacent the base of the net causes one or more of the pivot between the first position and the second vertical position, and to trap the ball between the net and one of the flaps in the vertical position.

4. The apparatus of claim 2 wherein the flaps have a dimension normal to the pivotal axis equal to the height of a tensile zone of the net.

5. The apparatus of claim 1 wherein the net is a mesh having a weight in the range of a 0.5 to 4 oz. per square foot.

6. The apparatus claim 1 wherein the collection tray has a weight in the order of 2½ oz. per square foot.

7. The apparatus claim 1 wherein the collection tray has a weight in the range of 1 to 5 oz. per square foot.

8. The apparatus of claim 1 wherein the flaps have a weight in the range of 2 to 10 oz. per square foot.

9. The apparatus of claim 1 wherein the flaps have a weight in the order of 5 oz. per square foot.

10. The apparatus of claim 2 wherein the exit chute is connected to a ball tossing device.

11. The apparatus of claim 1 operationally combined with a ball tossing device.

12. A return net device for receiving and arresting a ball and returning it to a collection point comprising:

a frame having a net frame portion and a collection frame portion, the collection frame portion being operatively associated with the net frame portion;

a net supported on the diagonal within the net frame; and an inclined collection tray supported by the collection frame wherein the net includes a vertical net portion hanging from the net frame, sufficiently loosely to avoid rebound of the ball and an inclined portion overlying the collection tray;

and wherein the collection tray is sufficiently tensioned to allow a ball to roll from the net to the collection point;

the device further including trap means adapted to inhibit any rebound of a ball striking a tensile zone of the net.

13. The device of claim 12 wherein the net has a tensile zone which comprises that portion of the hanging net below which there is insufficient net weight in a triangular portion of the hanging net portion between the point of ball impact and the base of the hanging net portion to arrest a ball striking the net.

14. The device of claim 13 wherein the trap means comprises one or more flaps pivotally connected at the base of the hanging net portion.

15. The return net device of claim 14 wherein a ball striking the tensile zone causes the flaps to rotate upwardly, trapping the ball against the hanging net portion.

16. The device of claim 15 wherein the flaps have a vertical dimension sufficient to trap a ball striking the tensile zone.

17. The device of claim 12 wherein the net is a mesh having a weight in the range of 0.5 to 4 oz. per square foot.

18. The device of claim 13 wherein the tray has a weight in the range of 1 to 5 oz. per square foot.

19. The device of claim 14 wherein the flaps have a weight in the range of 1 to 10 oz. per square foot.

* * * * *